US005882440A

United States Patent [19]

Shinosaki et al.

[11] Patent Number: 5,882,440

[45] Date of Patent: Mar. 16, 1999

[54] HEAT-RESISTANT ALLOY STEEL FOR HEARTH METAL MEMBERS OF STEEL MATERIAL HEATING FURNACES

[75] Inventors: Akira Shinosaki, Hirakata; Toru Kawai, Toyonaka; Yoshihide Shida, Hirataka, all of Japan

[73] Assignee: Kubota Corporation, Osaka, Japan

[21] Appl. No.: 928,502

[22] Filed: Sep. 12, 1997

[30] Foreign Application Priority Data

Oct. 21, 1996 [JP] Japan ..... 8-276752

[51] Int. Cl.[6] ..... C22C 19/05

[52] U.S. Cl. ..... 148/427; 148/442; 420/454; 420/585

[58] Field of Search ..... 420/453, 454, 420/580, 584, 585, 588; 148/325, 427, 442

[56] References Cited

U.S. PATENT DOCUMENTS

| | | | |
|---|---|---|---|
| 3,826,689 | 7/1974 | Ohta et al. | 148/3 |
| 4,153,455 | 5/1979 | Eiselstein et al. | 75/171 |
| 5,077,006 | 12/1991 | Culling | 420/584.1 |

FOREIGN PATENT DOCUMENTS

| | | |
|---|---|---|
| 51-011013 | 1/1976 | Japan . |
| 51-062126 | 5/1976 | Japan . |
| 51-084723 | 7/1976 | Japan . |
| 51-084725 | 7/1976 | Japan . |
| 54-18650 | 7/1979 | Japan . |
| 56-081661 | 7/1981 | Japan . |
| 56105458 | 8/1981 | Japan . |
| 63-44814 | 9/1988 | Japan . |
| 2194248 | 3/1988 | United Kingdom . |

*Primary Examiner*—Sikyin Ip

*Attorney, Agent, or Firm*—Armstrong, Westerman, Hattori, McLeland, and Naughton

[57] ABSTRACT

A heat-resistant alloy comprising, as expressed in % by weight, 0.03 to 0.1% of C, 0.2 to 0.7% of Si, 0.2 to 0.7% of Mn, 42 to 60% of Ni, 25 to 35%0 of Cr, 8 to 20% of W, over 0% to not more than 8% Mo, over 0% to not more than 5% of Co, and the balance substantially Fe. The alloy has improved resistance to compressive deformation and oxidation resistance for use in oxidizing atmospheres having a high temperature of 1250° C.

3 Claims, 1 Drawing Sheet

HEAT-RESISTANT ALLOY STEEL FOR HEARTH METAL MEMBERS OF STEEL MATERIAL HEATING FURNACES

FIELD OF THE INVENTION

The present invention relates to heat-resistant alloy steels having improved high-temperature characteristics and useful for skid buttons and like hearth metal members which are support members for the steel materials to be heated in heating furnaces.

BACKGROUND OF THE INVENTION

Steel materials such as slabs or billets are placed into a heating furnace prior to hot plastic working (for example, hot rolling or hot forging) and subjected to a specified heat treatment. Heating furnaces of the walking beam conveyor type have skid beams (fixed beams and movable beams) adapted to be internally cooled with water and arranged longitudinally of the furnace. The skid beams have attached thereto heat-resistant alloy blocks (skid buttons) arranged at a predetermined interval and serving as hearth metal members. The steel material placed into the furnace is transported within the furnace as supported by the skid buttons on the fixed beams and those on the movable beams alternately.

The hearth metal members must have oxidation resistance so as to be free of corrosion (oxidation wear) due to the high-temperature oxidizing internal atmosphere of the furnace, and such resistance to compressive deformation that the members will not readily deform even if repeatedly subjected to the compressive load of the heavy steel material to be heated. The materials conventionally used for hearth metal materials include high alloy steels such as high Ni-high Cr alloy steels (JIS G5122 SCH22, etc.) and Co-containing Ni-Cr alloy steels (e.g., 50Co—20Ni—30Cr—Fe). Also proposed as improved hearth alloy materials are 0.3–0.6% C—40–60% Ni—25–35% Cr—8–15% W—Fe alloys (Japanese post-examination publication SHO54-18650), 0.2–1.5% C+N—15–60% Ni—15–40% Cr—3–10% W—Fe alloys (Japanese post-examination publication SHO 63-44814), 1.0% ≧C—26–38% Cr—10–25% W—Ni alloys (U.S. Pat. No. 3,403,998), etc. Some of these alloys are already in actual use.

The operating temperature of steel material heating furnaces is elevated year after year for the treatment of a wide variety of steel materials, improvements in the quality of treated materials and savings in energy. It is common practice to operate the furnace at a high temperature of 1250° C. or higher, and the internal furnace temperature is likely to exceed 1300° C. Higher oxidation resistance and improved resistance to compressive deformation are required of the hearth metal members in order to carry out the high-temperature operation efficiently and safely.

However, the conventional heat-resistant alloys fail to fully withstand such high-temperature operations. Although it may be attempted to cool the hearth metal members more effectively by the internal water-cooling structure of the skid beams, the attempt leads to an increased heat loss due to the cooling water and uneven heating of the steel material to be treated as supported by the hearth metal members (occurrence of so-called "skid marks") and can not be a substantial countermeasure.

An object of the present invention is to provide a heat-resistant alloy steel having improved high-temperature characteristics in order to solve the above problem encountered with hearth metal members.

SUMMARY OF THE INVENTION

The present invention provides a heat-resistant alloy steel having a high melting point for hearth metal members of steel material heating furnaces, the alloy steel having a chemical composition consisting essentially of , as expressed in % by weight, 0.03 to 0.1% of C, 0.2 to 0.7% of Si, 0.2 to 0.7% of Mn, 42 to 60% of Ni, 25 to 35% of Cr, 8 to 20% of W, over 0% to not more than 8% of Mo, over 0% to not more than 5% of Co, and the balance substantially Fe.

DETAILED DESCRIPTION OF THE INVENTION

Figure 1:
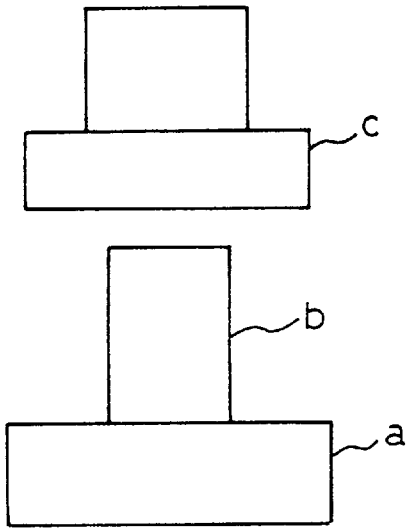
FIG. 1 is a diagram for illustrating a high-temperature compression test.

Given below are reasons for limiting the components of the heat-resistant alloy steel of the invention as above. The contents of elements are expressed in % by weight.

C: 0.03–0.1%

With heat-resistant alloy steels, it is common practice to cause C to combine, for example, with Cr or Fe and to give improved strength at high temperatures by the dispersion strengthening effect of the carbide precipitated, whereas the carbide becomes dissolved in the matrix at high temperatures of over 1250° C. at which the present steel is to be used, failing to contribute to the improvement of strength. Further it is desired to reduce the C content in affording alloy steels of high melting point because C exerts a great influence on the melting point of the alloy steel. According to the present invention, therefore, the C content is limited to not greater than 0.1% to obtain a high melting point, while the strengthening elements, such as W, Mo and Co, to be described below are added in combination so as to ensure the required strength at high temperatures. Although a lower C content is more advantageous in giving the alloy a higher melting point, the alloy which is prepared by a melting procedure becomes more costly. Further since the reduction of the C content below 0.03% entails no substantial benefit, this value is taken as the lower limit.

Si: 0.2–0.7%

Si serves as a deoxidizer in the alloy preparation process, affords improved castability and should be present in an amount of at least 0.2%. Increases in the Si content result in a lower melting point although effective for improving the oxidation resistance of the alloy, so that the upper limit should be 0.7%.

Mn: 0.2–0.7%

Mn is a deoxidizing-desulfurizing element and also contributes to the formation of a stabilized austenitic structure. However, an increase in the amount of the element lowers the melting point of the alloy. For this reason, at least 0.2% to not more than 0.7% of Si should be present.

Ni: 42–60%

Ni is the basic element of heat-resistant alloy steels, forms an austenitic structure, further forms a stabilized oxide film to give enhanced corrosion resistance when present conjointly with Cr, and has an effect to give improved high-temperature strength when present in combination with Cr, W or the like, affording enhanced resistance to compressive deformation. To ensure this effect, the Ni content should be at least 42% to not higher than 60%.

Cr: 25–35%

Cr is an element contributing to improvements in oxidation resistance and high-temperature strength. At least 25% of Cr needs to be present to obtain this effect. The upper limit should be 35% since presence of an excess of Cr results in impaired castability and lower high-temperature strength.

W: 8–20%

W affords improved compressive strength. At least 8% of W should be present to obtain this effect. The effect increases with an increase in the W content but nearly levels off when the content exceeds 20%. Excessive contents also adversely affect the oxidation resistance and castability of the alloy. The upper limit should therefore be 20%.

Mo: over 0% to not more than 8%

Mo is an element producing a favorable effect on the high-temperature compressive strength of the alloy and the elevation of the melting point thereof. This effect becomes more pronounced when Mo is added in combination with Co. Although an increase in the Mo content leads to an enhanced effect, use of up to 8% of the element achieves a satisfactory result, and greater amounts entail impaired economy, so that 8% is the upper limit. The preferred content is 0.5 to 5%.

Co: over 0% to not more than 5%

Co, like Mo, is favorable in imparting improved high-temperature compressive strength and higher melting point to the alloy, and this effect increases when Co is present conjointly with Mo. An increased Co content produces an enhanced effect, whereas Co is an expensive element and should therefore be present in an amount of up to 5% in view of the effect available and economy. The amount is preferably 0.5 to 3%.

The hearth member of the heat-resistant alloy steel of the invention is prepared by machining this material as cast to the required shape. The alloy steel of the invention has high strength and high resistance to oxidation to withstand operations at high temperatures of over 1250° C. The solidus of the steel indicates that the material has an exceedingly high melting point of at least 1300° C. The high melting points makes possible a design of hearth structure wherein the forced cooling from the skid beams is attenuated and the resulting reduction in the internal heat loss of the furnace.

The hearth metal member need not always be made entirely from the heat-resistant alloy steel of the invention. Depending on the construction of the hearth or furnace operating conditions, the member can be of a structure of superposed layers which comprises a block of conventional material providing a base portion of the member (i.e. , portion in contact with the skid beam and subjected to a relatively great forced cooling effect) , and an upper portion made from the steel of the invention and joined to the base portion.

EXAMPLES

A molten alloy prepared in a high-frequency melting furnace was cast, and the resulting cast material was machined to prepare test pieces. Table 1 shows the chemical compositions of the specimen alloys thus prepared, and the solidi, high-temperature compressive deformation resistance and oxidation resistance of the alloys determined. With reference to the table, the solidus (c) is a measurement obtained at a rate of rise of temperature of 3 min, and the amount of high-temperature deformation (%) and oxidation loss (mm/year) were measured by the following tests.

[High-Temperature Compression Test]

Figure 2:
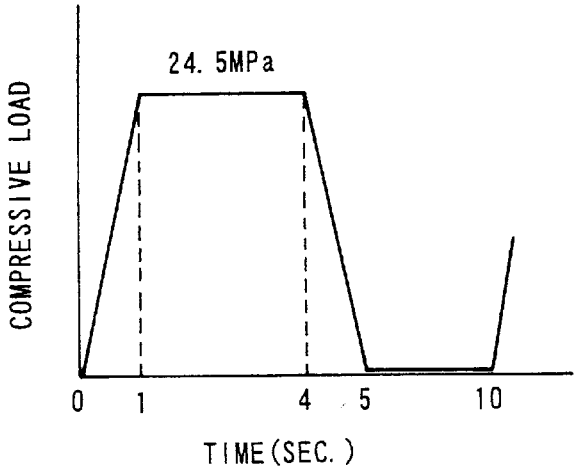
FIG. 2 is a diagram for illustrating repeated load cycles in the high-temperature compression test.

As shown in FIG. 1, a solid cylindrical test piece (b) was placed upright on a base (a), and a compressive load was applied to the test piece (b) by pressing a pressure jig (c) against the top face of the test piece. As shown in FIG. 2, the jig was held pressed for a predetermined period of time, and the test piece b was thereafter relieved of the load. This cycle was repeated a specified number of times, and the test piece b was thereafter checked to calculate the amount D of resulting compressive deformation from the following equation.

$$D=(L1-L0)/L0\times 100(\%)$$

Size of test piece: 30 (diameter)×50 L (mm)

Test temperature: 1300° C.

Compressive load: 24.5 MPa

Number of cycles: 2000

[Oxidation Test]

A solid cylindrical test piece was held in a heating furnace (natural atmosphere) for a predetermined period of time and thereafter checked for the variation in weight due to oxidation to calculate the rate of oxidation loss (mm/year).

Size of test piece: 8 (diameter)×50 L (mm)

Test temperature: 1250° C.

Test time: 100 hr

TABLE 1

| Specimen | Alloy Composition (wt %) | | | | | | | | | Solidus | High-temperature Compressive | High-temperature Oxidation Loss |
|---|---|---|---|---|---|---|---|---|---|---|---|---|
| No. | C | Si | Mn | Ni | Cr | W | Mo | Co | Fe | (°C.) | Deformation (%) | (mm/year) |
| 1 | 0.05 | 0.32 | 0.42 | 50.4 | 29.8 | 12.7 | 1.02 | 0.97 | Bal. | 1335 | 4.35 | 1.21 |
| 2 | 0.06 | 0.33 | 0.40 | 50.3 | 29.6 | 10.1 | 2.09 | 1.91 | Bal. | 1337 | 4.22 | 0.94 |
| 3 | 0.05 | 0.28 | 0.41 | 49.8 | 30.1 | 10.1 | 1.02 | 0.21 | Bal. | 1333 | 4.73 | 0.99 |
| 4 | 0.05 | 0.29 | 0.42 | 50.1 | 29.8 | 10.1 | 1.05 | 2.91 | Bal. | 1325 | 4.11 | 0.89 |
| 5 | 0.05 | 0.31 | 0.40 | 50.3 | 30.2 | 10.3 | 3.12 | 1.98 | Bal. | 1332 | 3.98 | 1.21 |
| 6 | 0.06 | 0.32 | 0.43 | 50.6 | 29.9 | 9.8 | 5.01 | 2.02 | Bal. | 1329 | 3.85 | 1.34 |
| 11 | 0.24 | 0.30 | 0.42 | 50.2 | 29.8 | 12.8 | — | — | Bal. | 1310 | 8.85 | 1.36 |
| 12 | 0.07 | 0.11 | 0.41 | 50.2 | 30.2 | 13.1 | — | — | Bal. | 1347 | 7.01 | 1.75 |
| 13 | 0.05 | 0.30 | 0.65 | 49.9 | 29.9 | 12.9 | — | — | Bal. | 1324 | 7.55 | 1.33 |
| 14 | 0.06 | 0.33 | 0.98 | 50.1 | 30.0 | 13.1 | — | — | Bal. | 1319 | 8.12 | 1.35 |
| 15 | 0.07 | 0.28 | 0.41 | 50.3 | 29.7 | 7.4 | — | — | Bal. | 1327 | 15.21 | 0.72 |
| 16 | 0.05 | 0.34 | 0.45 | 49.4 | 30.1 | 12.4 | 1.02 | — | Bal. | 1335 | 6.02 | 1.35 |
| 17 | 0.07 | 0.29 | 0.46 | 50.4 | 30.6 | 12.5 | 4.89 | — | Bal. | 1342 | 5.57 | 1.50 |
| 18 | 0.05 | 0.34 | 0.45 | 49.7 | 30.4 | 9.9 | 1.21 | — | Bal. | 1338 | 6.84 | 1.28 |
| 19 | 0.05 | 0.32 | 0.41 | 49.8 | 29.9 | 12.9 | — | 0.55 | Bal. | 1321 | 7.40 | 1.14 |
| 20 | 0.05 | 0.30 | 0.47 | 50.1 | 30.4 | 12.9 | — | 2.50 | Bal. | 1324 | 6.65 | 0.92 |
| 21 | 0.44 | 0.31 | 0.39 | 49.8 | 31.2 | 13.1 | — | — | Bal. | 1302 | 9.81 | 1.37 |
| 22 | 0.48 | 0.13 | 0.15 | 51.2 | 31.5 | 17.2 | — | — | Bal. | 1312 | 10.81 | 2.45 |

TABLE 1-continued

| Specimen | Alloy Composition (wt %) | | | | | | | | | Solidus | High-temperature Compressive | High-temperature Oxidation Loss |
|---|---|---|---|---|---|---|---|---|---|---|---|---|
| No. | C | Si | Mn | Ni | Cr | W | Mo | Co | Fe | (°C.) | Deformation (%) | (mm/year) |
| 23 | 0.14 | 0.30 | 0.45 | 50.0 | 29.9 | 12.9 | 5.03 | 2.10 | Bal. | 1308 | 6.15 | 1.40 |
| 24 | 0.23 | 0.29 | 0.43 | 50.3 | 30.0 | 9.5 | 2.10 | 1.98 | Bal. | 1309 | 6.52 | 1.35 |

In Table 1, No. 1 to No. 6 are examples of the invention, and No. 11 to No. 24 are comparative examples.

Of the comparative examples (No. 11 to No. 24), No. 11 to No. 20 are low C-high Ni—W alloys like the examples of the invention, and No. 21 and No. 22, which are heat-resistant alloys not containing the combination of Mo and Co, are conventional materials. No. 21 is a material corresponding to the alloy disclosed in Japanese post-examination publication SHO 54-18650, and No. 22 is a material corresponding to the alloy disclosed in U.S. Pat. No. 3,403,998. No. 23 and No. 24 are heat-resistant alloys containing larger amount of C. No. 24 is also a material corresponding to the alloy disclosed in Japanese post-examination publication SHO 63-44814.

A comparison between the examples of the invention No. 1 to No. 6 and the conventional materials No. 21 and No. 22 shows that as compared with the conventional materials, the examples of the invention are exceedingly higher in melting point and improved in resistance to compressive deformation and oxidation resistance. The comparative examples No. 11 to No. 20, although higher than the conventional materials in melting point, are not improved in both compressive deformation resistance and oxidation resistance and still remain to be improved unlike the materials of the invention. The comparative examples No. 23 and No. 24 are lower with respect to melting point and inferior in compresive deformation resistance.

The heat-resistant alloy steel of the present invention has high compressive deformation resistance, improved oxidation resistance and an exceedingly high melting point which are required of the hearth metal members for use in steel material heating furnaces. These improved high-temperature characteristics render the alloy steel useful for the hearth metal members to be subjected to high-temperature furnace operating conditions in recent years, ensuring improved durability, easier maintenance, stabilized furnace operation and higher furnace operation efficiency. The high melting point of the alloy steel mitigates the forced cooling of hearth metal members, diminishing the heat loss due to the removal of heat to the outside of the furnace and achieving savings in energy.

What is claimed is:

1. A hearth metal member for attachment on a skid beam of a walking beam conveyor type furnace said hearth metal member being adapted to support a steel material to be heated said hearth metal member being made at least partly of an alloy consisting of, as expressed in % by weight, 0.03 to 0.1% of C, 0.2 to 0.7% of Si, 0.2 to 0.7% of M, 42 to 60% of Ni, 25 to 35% of Cr, 10.1 to 20% of W, over 0% to not more than 8% of Mo, over 0% to not more than 5% of Co, and the balance substantially Fe.

2. The hearth metal member as defined in claim 1, wherein Mo is 0.5 to 5% and Co is 0.5 to 3%.

3. The hearth metal member as defined in claim 1, wherein said hearth metal member is a skid button.

* * * * *